US008072389B2

(12) United States Patent
Chang et al.

(10) Patent No.: US 8,072,389 B2
(45) Date of Patent: Dec. 6, 2011

(54) INTEGRATED MULTI-BAND ANTENNA MODULE

(76) Inventors: Pao-Sui Chang, Taoyuan County (TW); Yu-Sheng Wu, Taoyuan County (TW)

( * ) Notice: Subject to any disclaimer, the term of this patent is extended or adjusted under 35 U.S.C. 154(b) by 260 days.

(21) Appl. No.: 12/482,457

(22) Filed: Jun. 11, 2009

(65) Prior Publication Data

US 2010/0315294 A1 Dec. 16, 2010

(51) Int. Cl.

| | |
|---|---|
| ***H01Q 1/48*** | (2006.01) |
| ***H01Q 1/38*** | (2006.01) |
| ***H01Q 5/00*** | (2006.01) |
| ***H01Q 9/04*** | (2006.01) |

(52) U.S. Cl. ..... 343/846; 343/700 MS

(58) Field of Classification Search ..... 343/700 MS, 343/702, 846

See application file for complete search history.

(56) References Cited

U.S. PATENT DOCUMENTS

| | | | | |
|---|---|---|---|---|
| 7,446,717 | B2 * | 11/2008 | Hung et al. | 343/702 |
| 7,489,278 | B2 * | 2/2009 | Huang | 343/702 |
| 7,498,992 | B2 * | 3/2009 | Hung et al. | 343/702 |
| 7,501,987 | B2 * | 3/2009 | Wang et al. | 343/702 |
| 7,525,490 | B2 * | 4/2009 | Hung et al. | 343/702 |
| 7,541,985 | B2 * | 6/2009 | Lin | 343/700 MS |
| 7,626,550 | B2 * | 12/2009 | Tsai et al. | 343/700 MS |
| 7,633,448 | B2 * | 12/2009 | Su et al. | 343/702 |
| 7,642,967 | B2 * | 1/2010 | Wang et al. | 343/702 |
| 7,839,337 | B2 * | 11/2010 | Hung et al. | 343/700 MS |
| 7,839,342 | B2 * | 11/2010 | Su et al. | 343/702 |
| 7,868,831 | B2 * | 1/2011 | Hung et al. | 343/700 MS |

* cited by examiner

*Primary Examiner* — Douglas W Owens
*Assistant Examiner* — Jennifer Hu

(57) ABSTRACT

An integrated multi-band antenna module includes a first antenna body having a first body and a second body, and a second antenna body having a third body and a fourth body. The first to the fourth body have relative radiating portions, feed lines, and ground lines. The radiating portions have relative arms, antenna portions, feed arms, and conducting top plates. Resonant excitation sources are formed by capacitive coupling effects from gaps between the above components. The capacitive coupling effects also lower the inductance effect and the reflection loss. Mirror effect and large-scaling conducting top plates are used to raise a radiating effect. The relative gaps form the capacitive coupling effects to receive optimized frequencies so that a small-size integrated antenna with multi-band, high radiating effect, good resonant effect, and suitable for an ultra wide bandwidth operation is achieved.

4 Claims, 4 Drawing Sheets

INTEGRATED MULTI-BAND ANTENNA MODULE

FIELD OF THE INVENTION

The present invention relates to a multi-band antenna, and particular to an integrated multi-band antenna module using a mirror effect, capacitive coupling effect, arrangement of different plane antennas with proper separations and best matched impedances so as to have a better performance with multiple operating frequencies and operation for ultra wide bandwidth.

DESCRIPTION OF THE PRIOR ART

Communication systems using a Radio Frequency (RF) for transmitting signals will encounter an effect under multi-path transmission. The target signal from a source is reflected by objects so that the signals transmitted from multiple paths are received by an antenna. Signal dropout will happen because of neutralizations between different phases of multi-path signals. The problem usually happens indoors. An indoor wireless system emits signals in any directions, and the direct signal is the strongest signal. But in fact, signals will be reflected hundreds of times by various surfaces and the signal dropout happens. Signal dropout will also happen outdoors for the reflections from cars, signboards, and metal surfaces of buildings.

A Space diversity by installing at least one antenna to a receiver is usually a solution for the above problem. By the multiple antennas arranged with spacing receiving signals from different directions, the signal strength is thus improved. The spacing depends on the multi-path effect, and should be at least half of the wavelength of the operating frequency so as to ensure the antennas being capable of receiving signal with space diversity.

Therefore, the prior art has following disadvantages:

1. While multiple operating frequencies are applied to the combined antenna of the prior art, improper separations between antennas will cause noises to each other.

2. Too many antennas are added for applying various operating frequencies will damage an outer appearance and an usage.

3. The prior combined antenna is not suitable for ultra high bandwidth operation.

4. The prior art with high matched impedance and high reflection loss is a waste of time and cost.

Therefore, to solve the above disadvantages is the goal of the inventor of the present invention.

SUMMARY OF THE PRESENT INVENTION

Accordingly, the present invention provides a conducting top plate to form a capacitive coupling effect to a ground level so as to achieve a ultra high bandwidth and also suitable for multiple operating frequencies.

Therefore, the primary object of the present invention is to provide an integrated multi-band antenna module using a mirror effect, capacitive coupling effect, arrangement of different plane antennas with proper separations and best matched impedances so as to have a better performance with multiple operating frequencies and operation for ultra wide bandwidth.

A secondary object of the present invention is to provide an arrangement of the least antennas on an insulated plane to achieve a lowest reflection loss and a minimization of size.

A yet object of the present invention is to provide an antenna module with large-scaled conducting top plate to compensate weak signals, to raise radiating effect, to achieve low band resonance, also to form a combined mirror antenna.

To achieve above object, the present invention provides an integrated multi-band antenna module comprising a first antenna body 2 and a second antenna body; the first antenna body 2 having a first body 3 and a second body 4; the first body 3 including: a first radiating portion 31; a conductor being arranged onto a first insulated plane 3A, the conductor being formed with a first arm 310 which is formed as an approximate rotated S shape; a lower end of the first arm 310 being connected to a meddle section of a long first ground line 34; a first antenna portion 311 and a second antenna portion 312 being extended from another end of the first arm 310 in opposite directions parallel to the first ground line 34; the second antenna portion 312 having a first feed arm 331 perpendicular extending towards the first ground line 34; a first feed line 33 being conducted to the first feed arm 331; a rectangular second arm 320 being perpendicularly connected to an end of the first ground line 34; a first gap 313 between an end of the second antenna portion 312 and the second arm 320 generating a capacitive effect so that a first resonant excitation source 314 are formed; a second radiating portion 32; an upper end of the rectangular second arm 320 made of the conductor having a first conducting top plate 321; the first conducting top plate 321 being formed parallel to the first ground line 34; a second gap 322 being formed between the first conducting top plate 321 and the first ground line 34 so that a reversed L type antenna portion 323 is formed; a third gap 313 between the first conducting top plate 321 and the second antenna portion 312 generating a capacitive effect so that a second resonant excitation source 315 is formed; and a fourth gap 316 between the first conducting top plate 321 and the first antenna portion 311 generating the capacitive effect; the first feed line 33 having a first signal terminal 330 conducted to the first feed arm 331 and a first ground terminal 332 conducted to the first ground line 34; the first ground line 34 made of a conductor being the same potential of a ground level of an antenna receiver; the second body 4 including: a third radiating portion 41; a third arm 410 made of conductor being arranged onto a second insulated plane 4A; a lower end of the third arm 410 being connected to a middle section of a long second ground line 45; a second feed arm 431 being extended from the third arm 410 towards the second ground line 45; a second feed line 43 being conducted to the second feed arm 431; a third antenna portion 411 being extended upwards from an end of the third arm 410; a bent conducting portion 412 being extended upwards from a middle section of the third arm 410; an end of the conducting portion 412 being extended with a second conducting top plate 413 parallel to the second ground line 45 so as to from a fourth antenna portion 414; a fourth radiating portion 42 beside the third radiating portion 41; a fourth arm 420 made of a conductor being arranged onto the second insulated plane 4A; a lower end of the fourth arm 420 being connected to the second ground line 45; a third feed arm 441 being extended from the fourth arm 420 towards the second ground line 45; a third feed line 44 being conducted to the third feed arm 441; a fifth antenna portion 421 being extended upwards from an end of the fourth arm 420; a bent conducting portion 422 being extended upwards from a middle section of the fourth arm 420; an end of the conducting portion 422 being extended with a third conducting top plate 423 parallel to the second ground line 45 so as to from a sixth antenna portion 424; the second feed line 43 having a second signal terminal 430 conducted to the second feed arm 431 and a second ground terminal 432 conducted to the second ground line 45; the third feed line 44 having a third signal terminal 440 conducted to the third feed arm 441 and a third ground terminal 442 conducted to the second ground line 45; the second ground line 45 made of a conductor being a unity with the first ground line 34, and being the same potential of the ground level of the antenna receiver;

The second antenna body 5 has a third body 6 and a fourth body 7; the third body 6 including: a fifth radiating portion 61; the conductor being arranged onto a third insulated plane 6A; a fifth arm 610 made of the conductor being formed onto the third insulated plane 6A; a lower end of the fifth arm 610 being connected to a middle section of a long third ground line 65; a fourth feed arm 631 being inclinedly extended towards the third ground line 65 from an upper end of the fifth arm 610 so as to be conducted by a fourth feed line 63; a lower end of the fourth feed arm 631 further extending with a seventh antenna portion 611 and a eighth antenna portion 612 parallel to the third ground line 65; a parallel conducting portion 613 between the seventh and eighth antenna portions being extended from the fourth feed arm 631; an end of the conducting portion 613 being bent upwards and a fourth conducting top plate 614 being extended to be parallel to the third ground line 65 so that a ninth antenna portion 615 is formed; a sixth radiating portion 62; a sixth arm 620 made of the conductor being formed as an approximate reversed L shape; a lower end of the sixth arm 620 being connected to the third ground line 65; a fifth feed arm 641 being extended towards the third ground line 65 from the sixth arm 620 so as to be conducted by a fifth feed line 64; beside the fifth feed arm 620, a tenth antenna portion 621 being extended and bent upwards; a bent conducting portion 622 being upwards extended from a middle section of the sixth arm 620; a fifth conducting top plate 623 being extended parallel to the third ground line 65 from an upper end of the conducting portion 622 so that a eleventh antenna portion 624 is formed; the fourth feed line 63 having a fourth signal terminal 630 conducted to the fourth feed arm 631 and a fourth ground terminal 632 conducted to the third ground line 65; the fifth feed line 64 having a fifth signal terminal 640 conducted to the fifth feed arm 641 and a fifth ground terminal 642 conducted to the third ground line 65; the third ground line 65 made of the conductor being the same potential of the ground level of the antenna receiver; the fourth body 7 including a seventh radiating portion 71; a seventh arm 710 made of the conductor being arranged onto the fourth insulated plane 7A; a lower edge of the seventh arm 710 being connected to a long fourth ground line 74; a sixth conducting top plate 711 parallel to the fourth ground line 74 being connected to an upper edge of the seventh arm 710; a gap 712 between the sixth conducting top plate 71 and the fourth ground line 74 forming a ring antenna portion 713; an end of the ring antenna portion 713 extending downwards and further extending a twelfth antenna portion 714 and a thirteenth antenna portion 715 in contrary directions; the twelfth and the thirteenth antenna portions being parallel to the fourth ground line 74; on a middle section of the thirteenth antenna portion 715, a parallel fourteenth antenna portion 716 being downwards extended and bent; a capacitive coupling effect being formed between the thirteenth antenna portion 715 and the fourteenth antenna portion 716 so that a resonant excitation source 717 is formed; a bent portion of the fourteenth antenna portion 716 being arranged a sixth feed arm 731 so as to be conducted by a sixth feed line 73; a eighth radiating portion 72; a eighth arm 720 opposite to the seventh arm 710 being formed onto the fourth insulated plane 7A; a lower edge of the eighth arm 720 being conducted to the fourth ground line 74; a seventh conducting top plate 721 parallel to the fourth ground line 74 being connected to an upper edge of the eighth arm 720; a sixth gap 722 between the seventh conducting top plate 721 and the fourth ground line 74 forming a second ring antenna portion 723; a gap 725 between the seventh conducting top plate 721 and the sixth conducting top plate 711 forming a capacitive coupling effect; the capacitive coupling effect of the ring antenna to the ground forming a resonant excitation source 725; the radiating effect being raised by the similar shapes of the antennas; the sixth feed line 73 having a sixth signal terminal 730 conducted to the sixth feed arm 731 and a sixth ground terminal 732 conducted to the fourth ground line 74; the fourth ground line 74 made of the conductor being a unity with the third ground line 65, and being the same potential of the ground level of the antenna receiver.

The lengths of the first antenna portion to the fourteenth antenna portion are a quarter of the wavelengths of the relative operating frequencies.

The first to the seventh gaps with relative capacitive energies needed have relative resonant excitation frequencies.

The lengths of the reversed L antenna portions are a quarter of the wavelengths of the relative operating frequencies.

Relative gaps between the first conducting top plate (321) and the first ground line (34), the second conducting top plate (413) and the second ground line (45), the third conducting top plate (423) and the second ground line (45), the fourth conducting top plate (614) and the third ground line (65), the fifth conducting top plate (623) and the third ground line (65), the sixth conducting top plate (711) and the fourth ground line (74), the seventh conducting top plate (721) and the fourth ground line (74) form the capacitive coupling effect so as to receive optimized frequencies and capable of lowering the reflection loss.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
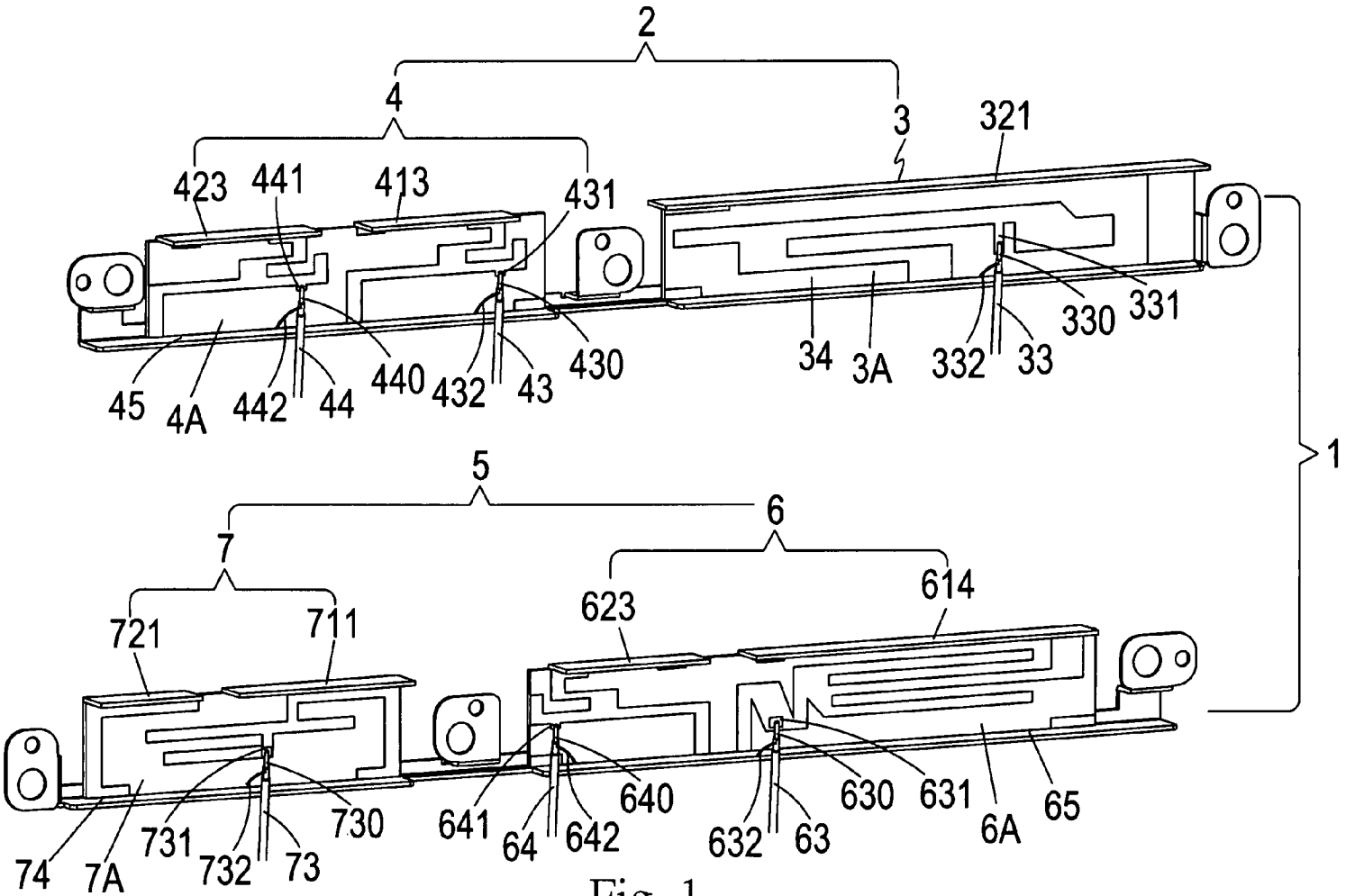
FIG. 1 is a pictorial drawing of an integrated multi-band antenna module of the present invention.
Figure 2:
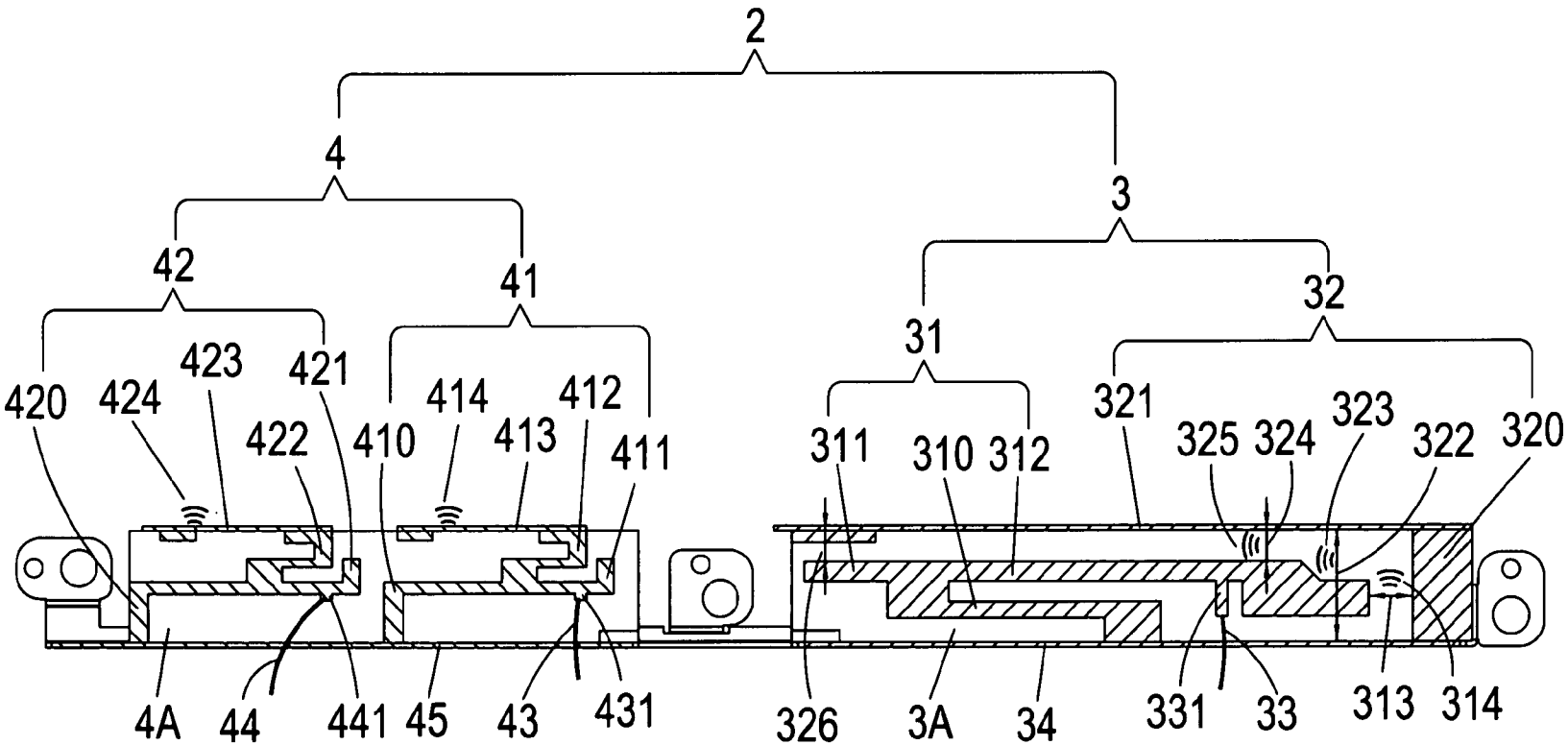
FIG. 2 is a pictorial drawing of a first antenna body of the present invention.
Figure 3:
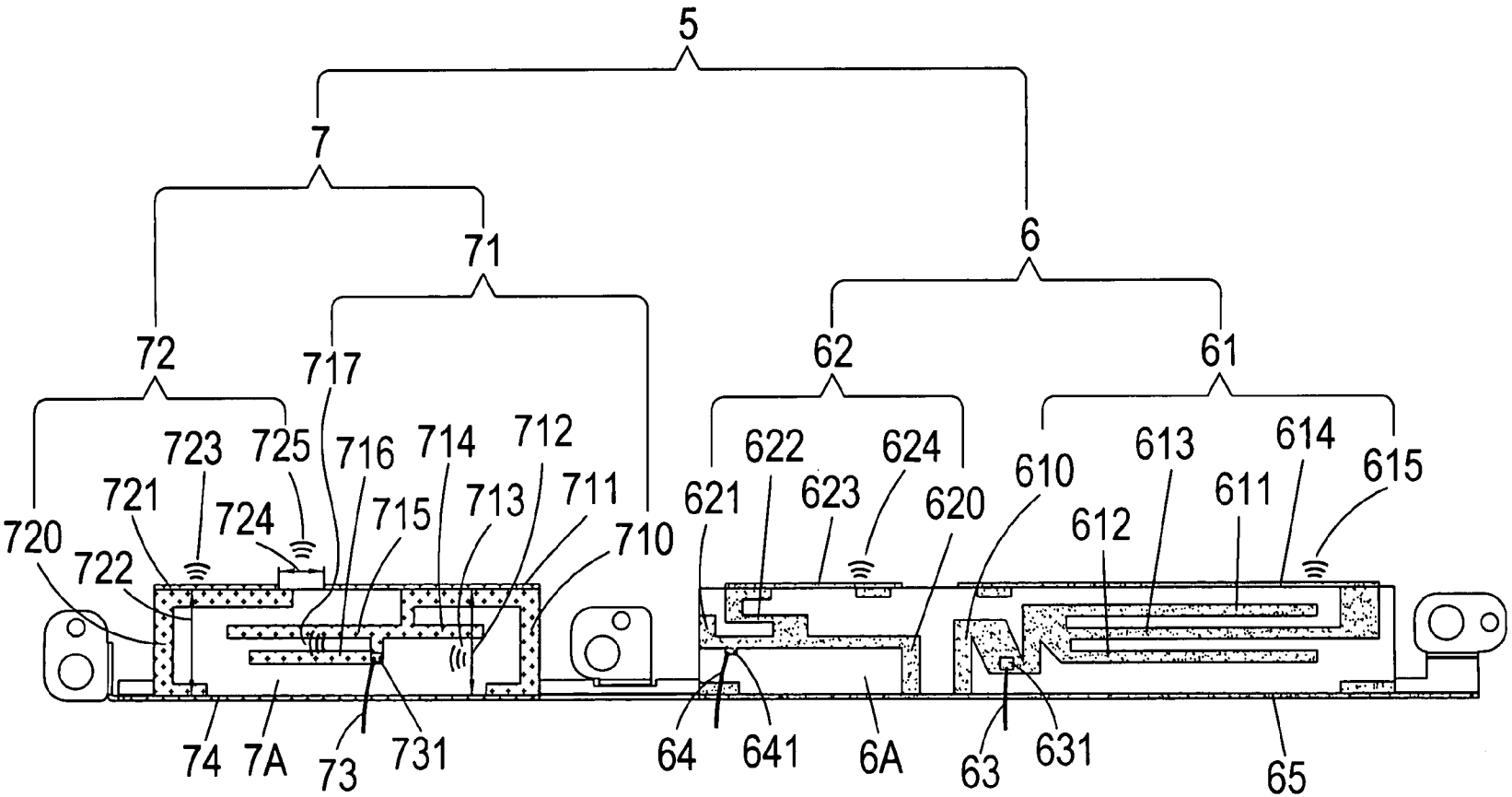
FIG. 3 is a pictorial drawing of a second antenna body of the present invention.

Referring to FIGS. 1 to 3, the outer appearance of a first antenna body and a second antenna body of an integrated multi-band antenna module according to the present invention are illustrated. The integrated multi-band antenna module 1 includes:

A first antenna body 2 has a first body 3 including: a first radiating portion 31; conductor being arranged onto a first insulated plane 3A, a first arm 310 made of the conductor being formed as an approximate rotated S shape; a lower end of the first arm 310 being connected to a meddle section of a long first ground line 34; a first antenna portion 311 and a second antenna portion 312 being extended from another end of the first arm 310 in contrary directions parallel to the first ground line 34; the second antenna portion 312 having a first feed arm 331 perpendicular extending towards the first ground line 34; a first feed line 33 being conducted to the first feed arm 331; a rectangular second arm 320 being perpendicularly connected to an end of the first ground line 34; a first gap 313 between an end of the second antenna portion 312 and the second arm 320 forming a capacitive effect so that a first resonant excitation source 314 are formed; a second radiating portion 32; an upper end of the rectangular second arm 320 made of the conductor having a first conducting top plate 321; the first conducting top plate 321 being formed parallel to the first ground line 34; a second gap 322 being formed between the first conducting top plate 321 and the first ground line 34 so that a reversed L type antenna portion 323 is formed; a radiating effect being raised by the similar shapes; a third gap 313 between the first conducting top plate 321 and the second antenna portion 312 forming the capacitive effect so that a second resonant excitation source 315 are formed; a forth gap 316 between the first conducting top plate 321 and the first antenna portion 311 forming the capacitive effect so that a inductance effect is lowered as well as a reflection loss of the reversed L type antenna portion 323; the first feed line 33 having a first signal terminal 330 conducted to the first feed arm 331 and a first ground terminal 332 conducted to the first ground line 34; the first ground line 34 made of the conductor being the same potential of a ground level of an antenna receiver; the first antenna body 2 further having a second body 4 including: a third radiating portion 41; a third arm 410 made of the conductor being arranged onto a second insulated plane 4A; a lower end of the third arm 410 being connected to a middle section of a long second ground line 45; a second feed arm 431 being extended from the third arm 410 towards the second ground line 45; a second feed line 43 being conducted to the second feed arm 431; a third antenna portion 411 being extended upwards from an end of the third arm 410; a bent conducting portion 412 being extended upwards from a middle section of the third arm 410; an end of the conducting portion 412 being extended a second conducting top plate 413 parallel to the second ground line 45 so as to from a fourth antenna portion 414; a fourth radiating portion 42 beside the third radiating portion 41; a fourth arm 420 made of the conductor being arranged onto the second insulated plane 4A; a lower end of the fourth arm 420 being connected to the second ground line 45; a third feed arm 441 being extended from the fourth arm 420 towards the second ground line 45; a third feed line 44 being conducted to the third feed arm 441; a fifth antenna portion 421 being extended upwards from an end of the fourth arm 420; a bent conducting portion 422 being extended upwards from a middle section of the fourth arm 420; an end of the conducting portion 422 being extended a third conducting top plate 423 parallel to the second ground line 45 so as to from a sixth antenna portion 424; the second feed line 43 having a second signal terminal 430 conducted to the second feed arm 431 and a second ground terminal 432 conducted to the second ground line 45; the third feed line 44 having a third signal terminal 440 conducted to the third feed arm 441 and a third ground terminal 442 conducted to the second ground line 45; the second ground line 45 made of the conductor being a unity with the first ground line 34, and being the same potential of the ground level of the antenna receiver.

A second antenna body 5 has a third body 6 including: a fifth radiating portion 61; the conductor being arranged onto a third insulated plane 6A; a fifth arm 610 made of the conductor being formed onto the third insulated plane 6A; a lower end of the fifth arm 610 being connected to a middle section of a long third ground line 65; a fourth feed arm 631 being inclined extended towards the third ground line 65 from an upper end of the fifth arm 610 so as to be conducted by a fourth feed line 63; a lower end of the fourth feed arm 631 further extending a seventh antenna portion 611 and a eighth antenna portion 612 parallel to the third ground line 65; a parallel conducting portion 613 between the seventh and eighth antenna portions being extended from the fourth feed arm 631; an end of the conducting portion 613 being bent upwards and a fourth conducting top plate 614 being extended parallel to the third ground line 65 so that a ninth antenna portion 615 is formed; a sixth radiating portion 62; a sixth arm 620 made of the conductor being formed as an approximate reversed L shape; a lower end of the sixth arm 620 being connected to the third ground line 65; a fifth feed arm 641 being extended towards the third ground line 65 from the sixth arm 620 so as to be conducted by a fifth feed line 64; beside the fifth feed arm 620, a tenth antenna portion 621 being extended and bent upwards; a bent conducting portion 622 being upwards extended from a middle section of the sixth arm 620; a fifth conducting top plate 623 being extended parallel to the third ground line 65 from an upper end of the conducting portion 622 so that a eleventh antenna portion 624 is formed; the fourth feed line 63 having a fourth signal terminal 630 conducted to the fourth feed arm 631 and a fourth ground terminal 632 conducted to the third ground line 65; the fifth feed line 64 having a fifth signal terminal 640 conducted to the fifth feed arm 641 and a fifth ground terminal 642 conducted to the third ground line 65; the third ground line 65 made of the conductor being the same potential of the ground level of the antenna receiver;

The second antenna body 5 further has a fourth body 7 including: a seventh radiating portion 71; a seventh arm 710 made of the conductor being arranged onto the fourth insulated plane 7A; a lower edge of the seventh arm 710 being connected to a long fourth ground line 74; a sixth conducting top plate 711 parallel to the fourth ground line 74 being connected to an upper edge of the seventh arm 710; a gap 712 between the sixth conducting top plate 71 and the fourth ground line 74 forming a ring antenna portion 713; an end of the ring antenna portion 713 extending downwards and further extending a twelfth antenna portion 714 and a thirteenth antenna portion 715 in contrary directions; the twelfth and the thirteenth antenna portions being parallel to the fourth ground line 74; on a middle section of the thirteenth antenna portion 715, a parallel fourteenth antenna portion 716 being downwards extended and bent; a capacitive coupling effect being formed between the thirteenth antenna portion 715 and the fourteenth antenna portion 716 so that a resonant excitation source 717 is formed; a bent portion of the fourteenth antenna portion 716 being arranged a sixth feed arm 731 so as to be conducted by a sixth feed line 73; a eighth radiating portion 72; a eighth arm 720 opposite to the seventh arm 710 being formed onto the fourth insulated plane 7A; a lower edge of the eighth arm 720 being conducted to the fourth ground line 74; a seventh conducting top plate 721 parallel to the fourth ground line 74 being connected to an upper edge of the eighth arm 720; a sixth gap 722 between the seventh conducting top plate 721 and the fourth ground line 74 forming a second ring antenna portion 723; a gap 725 between the seventh conducting top plate 721 and the sixth conducting top plate 711 forming a capacitive coupling effect; the capacitive coupling effect of the ring antenna to the ground forming a resonant excitation source 725; the radiating effect being raised by the similar shapes of the antennas; the sixth feed line 73 having a sixth signal terminal 730 conducted to the sixth feed arm 731 and a sixth ground terminal 732 conducted to the fourth ground line 74; the fourth ground line 74 made of the conductor being a unity with the third ground line 65, and being the same potential of the ground level of the antenna receiver.

Referring to FIG. 1, relative gaps between the first conducting top plate 321 and the first ground line 34, the second conducting top plate 413 and the second ground line 45, the third conducting top plate 423 and the second ground line 45, the fourth conducting top plate 614 and the third ground line 65, the fifth conducting top plate 623 and the third ground line 65, the sixth conducting top plate 711 and the fourth ground line 74, the seventh conducting top plate 721 and the fourth ground line 74 form the capacitive coupling effect so as to receive optimized frequencies and lower the reflection loss.

Furthermore, the lengths of the reversed L antenna portions of the integrated multi-band antenna module according to the present invention are one fourth of the wavelengths of the relative operating frequencies. Besides, the first to the seventh gaps with the relative resonant excitation frequencies form an ultra high bandwidth. The lengths of the first antenna portion to the fourteenth antenna portion are one fourth of the wavelengths of the relative operating frequencies.

Figure 4:
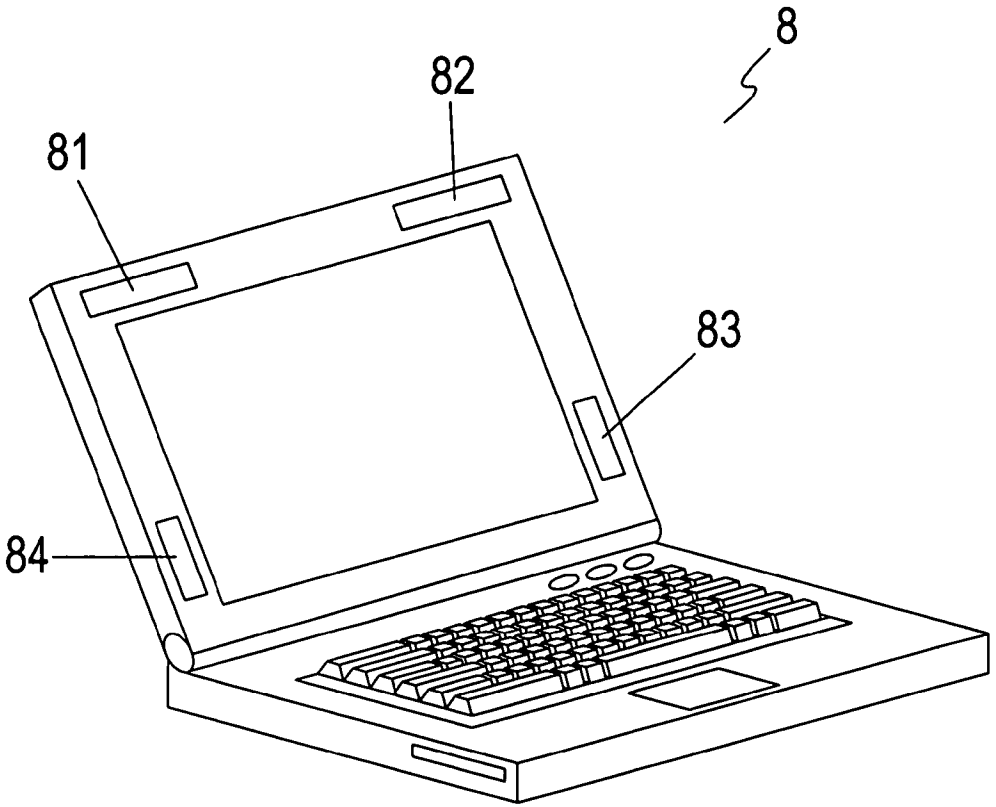
FIG. 4 is a schematic view showing an embodiment of the present invention applied to a laptop.

With reference to FIG. 4, an embodiment of the present invention applied to a laptop is illustrated. The present invention embedded to the laptop 8 on upper positions 81,82 or two lateral positions 83, 84 next to a screen so that the laptop 8 will have antennas for a low band, high band, 802.11a, 802.11b/g, WiMAX, Bluetooth, UWB (BG1 and BG3) within the integrated multi-band antenna module.

For the improvement and the practicability of the present invention, advantages are listed in the following:

1. Different type antennas are arranged on the insulated plane to minimize a size and a quantity of antenna and to lower a reflection loss.

2. Large-scaling conducting top plates are used to compensate weak signals, to raise radiating effect, to achieve low band resonance, also form a combined mirror antenna.

3. Insulated gaps form capacitive coupling effects and resonance excitation sources so that the radiating portions are simplified and the structure is simple and convenient.

4. The conducting top plate of the present invention forms inductance, capacitive effect and also mirror effect so as to save space and cost.

5. Operating frequencies are defined by gaps between relative conducting top plates and ground line so that extra radiating portions are not needed. Thus, an outer appearance is concise and succinct.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An integrated multi-band antenna module comprising a first antenna body (2) and a second antenna body (5);

the first antenna body (2) having a first body (3) and a second body (4);

the first body (3) including:

a first radiating portion (31); a conductor being arranged onto a first insulated plane (3A), the conductor being formed with a first arm (310) which is formed as an approximate rotated S shape; a lower end of the first arm (310) being connected to a middle section of a long first ground line (34); a first antenna portion (311) and a second antenna portion (312) being extended from another end of the first arm (310) in opposite directions parallel to the first ground line (34); the second antenna portion (312) having a first feed arm (331) perpendicular extending towards the first ground line (34); a first feed line (33) being conducted to the first feed arm (331); a rectangular second arm (320) being perpendicularly connected to an end of the first ground line (34); a first gap (313) between an end of the second antenna portion (312) and the second arm (320) generating a first capacitive effect so that a first resonant excitation source (314) is formed;

a second radiating portion (32); an upper end of the rectangular second arm (320) made of the conductor having a first conducting top plate (321); the first conducting top plate (321) being formed parallel to the first ground line (34); a second gap (322) being formed between the first conducting top plate (321) and the first ground line (34) so that a reversed L type antenna portion (323) is formed; a third gap (324) between the first conducting top plate (321) and the second antenna portion (312) generating a second capacitive effect so that a second resonant excitation source (323) is formed; and a fourth gap (316) between the first conducting top plate (321) and the first antenna portion (311) generating the capacitive effect;

the first feed line (33) having a first signal terminal (330) conducted to the first feed arm 331 and a first ground terminal (332) conducted to the first ground line (34);

the first ground line (34) made of the conductor being the same potential of a ground level of an antenna receiver;

the second body (4) including:

a third radiating portion (41); a third arm (410) made of the conductor being arranged onto a second insulated plane (4A); a lower end of the third arm (410) being connected to a middle section of a long second ground line (45); a second feed arm (431) being extended from the third arm (410) towards the second ground line (45); a second feed line (43) being conducted to the second feed arm (431); a third antenna portion (411) being extended upwards from an end of the third arm (410); a first bent conducting portion (412) being extended upwards from a middle section of the third arm (410); an end of the first conducting portion (412) being extended with a second conducting top plate (413) parallel to the second ground line (45) so as to form a fourth antenna portion (414);

a fourth radiating portion (42) beside the third radiating portion (41); a fourth arm (420) made of the conductor being arranged onto the second insulated plane (4A); a lower end of the fourth arm (420) being connected to the second ground line (45); a third feed arm (441) being extended from the fourth arm (420) towards the second ground line (45); a third feed line (44) being conducted to the third feed arm (441); a fifth antenna portion (421) being extended upwards from an end of the fourth arm (420); a second bent conducting portion (422) being extended upwards from a middle section of the fourth arm (420); an end of the conducting portion (422) being extended with a third conducting top plate (423) parallel to the second ground line (45) so as to from a sixth antenna portion (424);

the second feed line (43) having a second signal terminal (430) conducted to the second feed arm (431) and a second ground terminal (432) conducted to the second ground line (45);

the third feed line (44) having a third signal terminal (440) conducted to the third feed arm (441) and a third ground terminal (442) conducted to the second ground line (45);

the second ground line (45) made of the conductor being a unity with the first ground line (34), and being the same potential of the ground level of the antenna receiver;

the second antenna body (5) having a third body (6) and a fourth body (7);

the third body (6) including:

a fifth radiating portion (61); the conductor being arranged onto a third insulated plane (6A); a fifth arm (610) made of the conductor being formed onto the third insulated plane (6A); a lower end of the fifth arm (610) being connected to a middle section of a long third ground line (65); a fourth feed arm (631) being diagonally extended towards the third ground line (65) from an upper end of the fifth arm (610) so as to be conducted by a fourth feed line (63); a lower end of the fourth feed arm (631) further extending with a seventh antenna portion (611) and a eighth antenna portion (612) parallel to the third ground line (65); a parallel conducting portion (613) between the seventh and eighth antenna portions being extended from the fourth feed arm (631); an end of the parallel conducting portion (613) being bent upwards and a fourth conducting top plate (614) being extended to be parallel to the third ground line (65) so that a ninth antenna portion (615) is formed;

a sixth radiating portion (62); a sixth arm (620) made of the conductor being formed as an approximate reversed L shape; a lower end of the sixth arm (620) being connected to the third ground line (65); a fifth feed arm (641) being extended towards the third ground line (65) from the sixth arm (620) so as to be conducted by a fifth feed line (64); beside the fifth feed arm (620), a tenth antenna portion (621) being extended and bent upwards; a third bent conducting portion (622) being upwards extended from a middle section of the sixth arm (620); a fifth conducting top plate (623) being extended parallel to the third ground line (65) from an upper end of the conducting portion (622) so that a eleventh antenna portion (624) is formed;

the fourth feed line (63) having a fourth signal terminal (630) conducted to the fourth feed arm (631) and a fourth ground terminal (632) conducted to the third ground line (65);

the fifth feed line (64) having a fifth signal terminal (640) conducted to the fifth feed arm (641) and a fifth ground terminal (642) conducted to the third ground line (65);

the third ground line (65) made of the conductor being the same potential of the ground level of the antenna receiver;

the fourth body (7) including a seventh radiating portion (71); a seventh arm (710) made of the conductor being arranged onto a fourth insulated plane (7A); a lower edge of the seventh arm (710) being connected to a long fourth ground line (74); a sixth conducting top plate (711) parallel to the fourth ground line (74) being connected to an upper edge of the seventh arm (710); a fifth gap (712) between the sixth conducting top plate (71) and the fourth ground line (74) forming a first ring antenna portion (713); an end of the first ring antenna portion (713) extending downwards and further extending a twelfth antenna portion (714) and a thirteenth antenna portion (715) in contrary directions; the twelfth and the thirteenth antenna portions being parallel to the fourth ground line (74); on a middle section of the thirteenth antenna portion (715), a parallel fourteenth antenna portion (716) being downwards extended and bent; a first capacitive coupling effect being formed between the thirteenth antenna portion (715) and the fourteenth antenna portion (716) so that a third resonant excitation source (717) is formed; a bent portion of the fourteenth antenna portion (716) being arranged a sixth feed arm (731) so as to be conducted by a sixth feed line (73);

a eighth radiating portion (72); a eighth arm (720) opposite to the seventh arm (710) being formed onto the fourth insulated plane (7A); a lower edge of the eighth arm (720) being conducted to the fourth ground line (74); a seventh conducting top plate (721) parallel to the fourth ground line (74) being connected to an upper edge of the eighth arm (720); a sixth gap (722) between the seventh conducting top plate (721) and the fourth ground line (74) forming a second ring antenna portion (723); a seventh gap (725) between the seventh conducting top plate (721) and the sixth conducting top plate (711) forming a second capacitive coupling effect; the second capacitive coupling effect of the ring antenna to the ground forming a resonant excitation source (725); the radiating effect being raised by the similar shapes of the antennas;

the sixth feed line (73) having a sixth signal terminal (730) conducted to the sixth feed arm (731) and a sixth ground terminal (732) conducted to the fourth ground line (74);

the fourth ground line (74) made of the conductor being a unity with the third ground line (65), and being the same potential of the ground level of the antenna receiver.

2. The integrated multi-band antenna module (1) as claimed in claim 1, wherein the lengths of the first antenna portion to the fourteenth antenna portion are a quarter of the wavelengths of the relative operating frequencies.

3. The integrated multi-band antenna module (1) as claimed in claim 1, wherein the first to the seventh gaps with relative capacitive energies needed have relative resonant excitation frequencies.

4. The integrated multi-band antenna module (1) as claimed in claim 1, wherein relative gaps between the first conducting top plate (321) and the first ground line (34), the second conducting top plate (413) and the second ground line (45), the third conducting top plate (423) and the second ground line (45), the fourth conducting top plate (614) and the third ground line (65), the fifth conducting top plate (623) and the third ground line (65), the sixth conducting top plate (711) and the fourth ground line (74), the seventh conducting top plate (721) and the fourth ground line (74) form the capacitive coupling effect so as to receive optimized frequencies and capable of lowering the reflection loss.

* * * * *